US005230113A

United States Patent [19]

Foster et al.

[11] Patent Number: 5,230,113

[45] Date of Patent: Jul. 27, 1993

[54] MULTIPLE POSITION ADJUSTABLE DAY NIGHT PATIENT BED CHAIR

[75] Inventors: Dean B. Foster, Lexington; Harlan Caldwell, Christiansburg; Kenneth Harris; Stephen A. Riley, Jr., both of Lexington, all of Va.; Henry G. Williams, III, Atlanta, Ga.

[73] Assignee: Good Turn, Inc., Lexington, Va.

[21] Appl. No.: 868,192

[22] Filed: Apr. 14, 1992

[51] Int. Cl.[5] ..... A61G 7/00; A61G 7/02

[52] U.S. Cl. ..... 5/608; 5/604; 5/607; 5/610; 5/616; 5/83.1; 5/86.1

[58] Field of Search ..... 5/600, 604, 607–610, 5/612, 613, 616, 81.1, 86.1, 88.1, 89.1, 900.5

[56] References Cited

U.S. PATENT DOCUMENTS

| | | | |
|---|---|---|---|
| D. 276,756 | 12/1984 | Persson . | |
| 1,487,150 | 3/1924 | Deakins | 5/88.1 |
| 3,379,450 | 4/1960 | Jones et al. | 5/86.1 X |
| 3,562,824 | 2/1971 | White | 5/604 X |
| 3,875,598 | 4/1975 | Foster et al. . | |
| 4,085,471 | 4/1978 | DiMatteo et al. . | |
| 4,190,913 | 3/1980 | DiMatteo et al. . | |
| 4,199,829 | 4/1980 | Watanabe et al. . | |
| 4,225,988 | 10/1980 | Cary et al. . | |
| 4,357,722 | 11/1982 | Thompson . | |
| 4,403,357 | 9/1983 | Degen | 5/618 |
| 4,432,353 | 2/1984 | Vrzalik . | |
| 4,435,862 | 3/1984 | King et al. | 5/616 X |
| 4,589,151 | 5/1986 | Behrens | 5/616 X |
| 4,685,159 | 8/1987 | Oetiker | 5/608 |
| 4,760,615 | 8/1988 | Furniss . | |
| 4,763,643 | 8/1988 | Vrzalik . | |
| 4,791,687 | 12/1988 | Iwase | 5/900.5 X |
| 4,843,665 | 7/1989 | Cockel et al. | 5/88.1 |
| 4,852,193 | 8/1989 | Alsip et al. | 5/613 X |
| 4,860,394 | 8/1989 | Benessis et al. | 5/607 X |

*Primary Examiner*—Michael F. Trettel
*Attorney, Agent, or Firm*—Oliff & Berridge

[57] ABSTRACT

A manually or automatically controlled adjusting bed-chair combination for persons suffering limited mobility due to accident, disease, or age who thus require intensive caregiving efforts by others. This portable body supporting device provides a patient with greater mobility and self-care even if he/she is confined therein for weeks, months, or longer. The bed-chair includes an upper frame for supporting the invalid's body in a large number of postures ranging from side, supine, sitting, reclining or standing. In turn, this upper frame is articulated by lower supporting frames powered by linear actuators, or the equivalent, and controlled by the patient control or the caregiver's override and automatically preset control to provide a timed regimen of turning or tilting according to the occupant's needs. Whether in bed or chair mode, the support frame consists of an upper body, middle and leg-foot segment. The mid-section provides a base to which the other two sections are pivotally mounted. Turning the middle section up to 20° right or left relieves the local pressure on skin and other tissue yielding comfort and avoiding ulceration, cramping and discomfort. The optional accessories further increase the freedom of choice of more positions, actions, and controls, even to sensing difficulty and aiding excretion along with the option of using vibration and other therapeutic stimulations. The bed-chair's diverse positions enable easier entrance and exit. Ready disassembly into three or more sections facilitates transport. A mattress with special foam distributes the body weight over maximum area while cervical and lumbar supports plus adjustable edge tubes give security and comfort choice to abet healing.

37 Claims, 8 Drawing Sheets

MULTIPLE POSITION ADJUSTABLE DAY NIGHT PATIENT BED CHAIR

BACKGROUND OF THE INVENTION

1. Field of the Invention

The invention relates generally to an apparatus permitting either the patient or a caregiver to adjust the positions of a segmented bed-chair combination to facilitate comfort and relief from discomfort along with ease of patient transfer from the bed to a wheel chair, toilet, walker or other apparatus associated with treatment, change of bed clothing and hygienic maintenance.

2. Description of the Related Art

Immobility and prolonged confinement present both psychological and physically evident pathological problems to patients, ranging from malaise, depression, feelings of helplessness and loss of motivation on the one hand to decubitus ulcers, loss of local circulation and unsanitary dermatologic insult from waste products, or edema of extremities and gangrene on the other. Not only are patients affected by these conditions but so too are the responsible caregivers who must lift, turn, wash, change bed and clothing, arrange for food and dispose of waste. Such operations often require that attendants have a high level of strength and skill to move and reposition the patient, regardless of the patient's size or weight.

To address various aspects of these problems, a number of devices have been developed. Among these is the cradling and articulated bed disclosed in U.S. Pat. No. 3,875,598, held by one of the inventors of the instant device. The subject bed is capable of widening and narrowing to create either a flat bed surface or a cradle bed surface. In addition, the supporting surface is capable of powered rotation either to one side or the other allowing the patient to be rolled easily and it is further capable of elevating a head portion, a thigh portion and a calf portion to permit the patient to be moved to a multitude of reclining and seated positions. The disclosure of this patent is incorporated by reference herein.

U.S Pat. Nos. 4,085,471 and 4,190,913, to DiMatteo et al, are directed to invalid bed arrangements which allow a patient to use a toilet without leaving the bed or, alternatively, for placing a patient in a wheel chair. The bed is divided into three sections comprised of head, central and foot sections. The bed can be manipulated to elevate a patient from a supine to an upright seated position for using a toilet or movement into a wheel chair.

U.S. Pat. No. 4,199,829, to Watanabe et al, discloses a patient carrier that transfers a patient from cooperating bed systems to cooperating wheel chairs. The apparatus comprises a carrier with three groups of forks that are insertable into slots in the bed mat or seat and back rests of a wheel chair thereby permitting the patient to be moved from one to the other.

U.S. Pat. No. 4,225,988, to Cary et al, discloses a bed assembly that has a plurality of mattress support members that can be moved to provide a variety of patient positions from fully reclining to various seated positions with legs angled and supported. Alternatively, the apparatus facilitates turning of the patient by permitting elevation of one side or the other of the mattress support U.S. Pat. Nos. 4,432,353 and 4,763,643, both to Vrzalik, disclose a kinetic treatment table for a therapeutic insulating bed. The bed is capable of being lifted or lowered, tilted at an angle, and is further capable of raising a portion of the bed to prop a patient into an upright position.

U.S. Pat. No. 4,760,615, to Furniss, discloses a device for raising and transporting patients involving a tiltable platform and hinged head and foot platforms. U.S. Pat. No. 276,756, to Persson, shows an apparatus for turning a person confined to a bed and U.S. Pat. No. 4,357,722, to Thompson, discloses a bed with an adjustably tensionable patient supporting net. The bed has a cradle-like frame supported for pivotable movement by a base frame.

In the foregoing, various aspects of patient movement have been addressed. However, none of the systems address the multitude of other problems encountered by either the caregiver or the patient. In particular, none gives the patient the ability to adjust his/her body position and thus take control over somatic movement which action yields many important psychological benefits. Moreover, each is focused on a particular patient problem to the exclusion of related issues, some of them created by the attempt to solve the problem at hand. Furthermore as a group they are cumbersome and most are needlessly arcane in their approach to solving a problem.

SUMMARY OF THE INVENTION

Conventional hospital beds have no provision for the difficulties noted above, nor do conventional patient chairs, recliners or chaise-lounge like devices in which the enduringly bedridden geriatric patients are so generally incarcerated, especially during the day. Accordingly, it is an object of the present invention to provide the caregiver a means for lifting, turning, cleaning, transporting, and articulating the bed ridden patient without having to move that patient from one surface to another, such as from a bed to a chair or to another bed as the need arises, while simplifying such movement.

It is a further object of the invention to provide means for the patient, within limits established by the caregiver, to adjust his/her body position, thereby providing the necessary stimulation and psychological well-being provided by having some control over one's care so important for recovery and quality of life.

It is a further object of the invention to provide a simple means for transfer of a patient from a bed onto his feet for transfer to a wheel chair, movement to a bathroom, x-ray, surgery and so on without the requirement for lifting or undue physical handling of the patient.

It is another objective of the invention to provide a bed that assumes a multitude of positions while providing safe and restful support to the head, neck and upper body, thighs and lower legs in each of their multiple positions while cradling the patient, thereby providing a sense of security It is a further object of the invention to provide a means for preventing bed sores by inducing a controllable or continuous side-to-side rocking motion to the bed, thereby changing the pressure points between the patient and the mattress.

To achieve the above objectives, a bed frame having three sections is presented: a mid-section receiving the buttocks and upper thighs of the patient, a lower leg section, pivotally mounted to the mid-section, for supporting the lower legs and an upper section, also pivotally mounted to the mid-section, for supporting the upper body. Between the side frames are suspended a support structure forming a slight concave curvature so as to provide a cradle-like effect to the patient lying therein.

The mid-section of the bed is mounted on an articulated base, the base providing, by means of a plurality of actuators, the ability to turn the bed from approximately 20° right to approximately 20° left (to include when desired, an intermittent or continuous rocking or turning motion), to elevate the upper section, to lower the lower leg section, to stabilize the bed-chair in a flat bed configuration, or to angle the mid-segment, in conjunction with movement of the upper and lower leg sections as appropriate, to assist the patient to a standing position.

A mattress, preferably of a foam coverable construction having inflatable cushions along its longitudinal edges, is placed over the support portion and can be covered with a sheet or sheet and blanket. The inflatable side cushions provide support for the patient when the bed is turned to either side. The mattress may also include inflatable portions at the neck and lower back regions for providing support to these critical cervical and lumbar portions of the spine. Safety siderails or arm rests are provided on both sides of the bed-chair at the mid-section.

The bed may be controlled by the patient using a manual control or voice, by a caregiver, by both, or by automatic adjustable controls with the caregiver having an override capability to prevent the patient from adjusting the bed to positions contraindicated by a physician or by common wisdom.

BRIEF DESCRIPTION OF THE DRAWINGS

The invention will now be described with respect to the preferred embodiment thereof and with reference to the illustrative drawings appended hereto. The drawings are provided for the purpose of explanation and are not intended to limit the scope of the invention in any way.

DESCRIPTION OF THE PREFERRED EMBODIMENT

Figure 1:
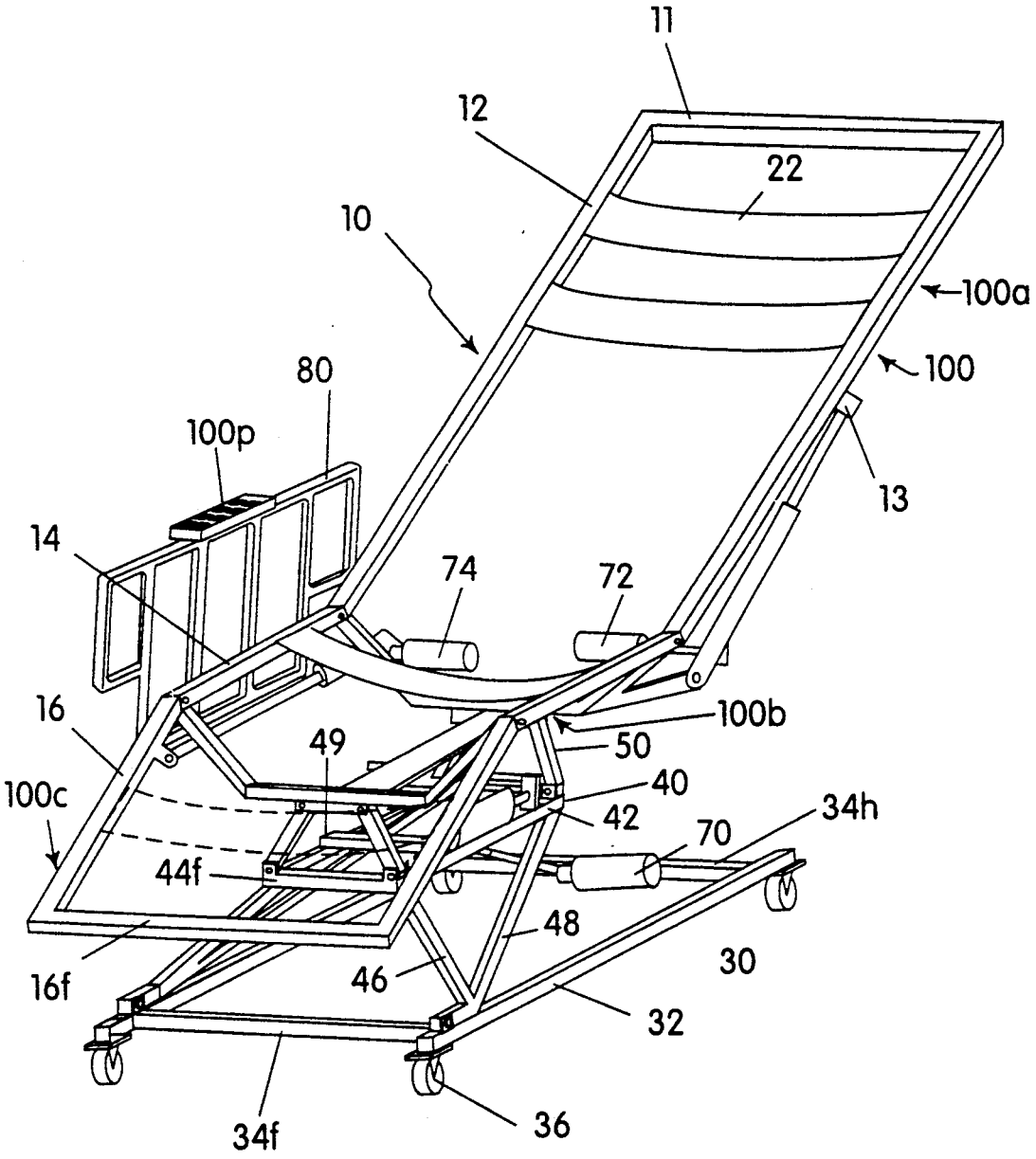
FIG. 1 is a side perspective view of the bed-chair without mattress or other upholstering.

The bed chair will be described, illustratively, with reference to the accompanying drawings. The bed chair 10 comprises an upper frame 100, a base frame 30, a mid-frame 40 and a linking assembly 50.

Figure 2:
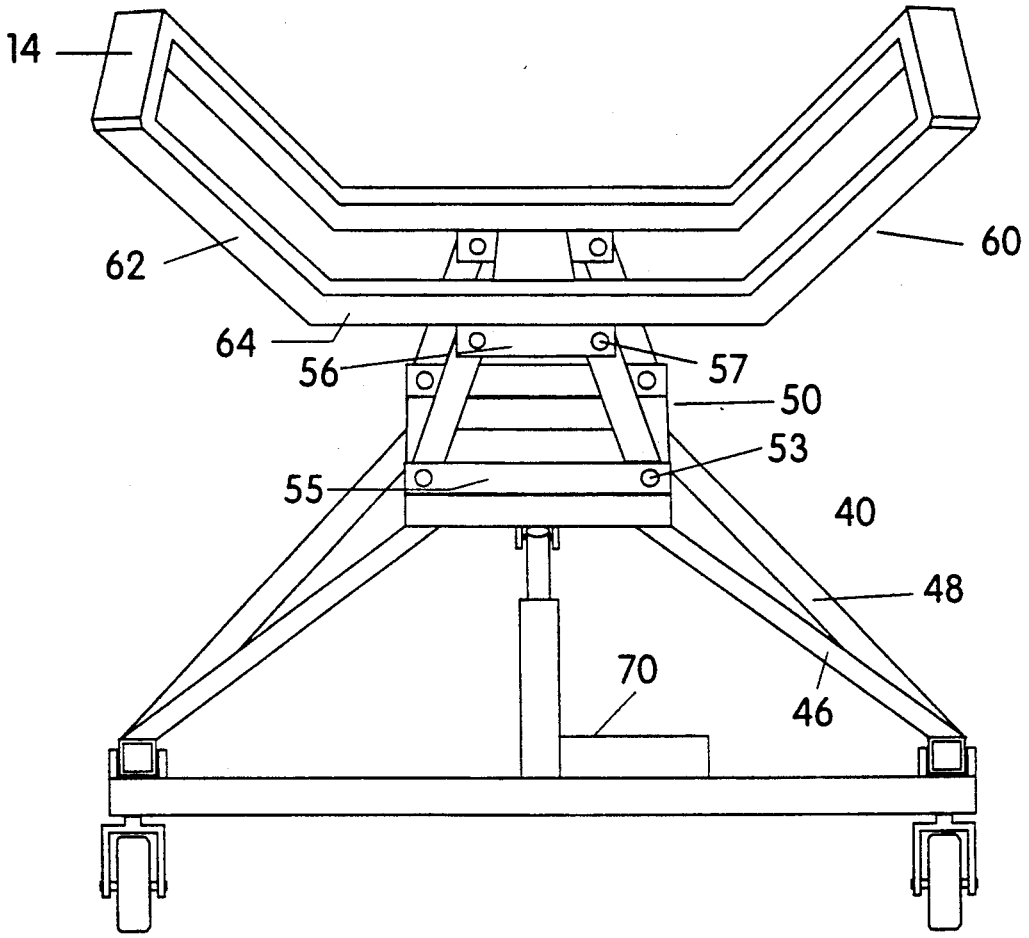
FIG. 2 is a front perspective view of the support structure of the bed-chair (without the upper frame) and of the means for moving the upper frame.

The upper frame 100 has three sections A mid-section 100*b* has two side rails 14 and, connecting the side rails and holding them rigidly apart, a cross brace assembly. The cross brace assembly comprises two cross braces 60, each having a bar like center portion 64 and an angled extension 62 at each end. The cross braces 60 present the appearance of a truncated "V" when viewed end on (FIG. 2). For each cross brace 60, an angled extension 62 is connected to and descends downwardly and inwardly from each side rail 14 toward a center line of a longitudinal axis of the bed.

Pivotally attached at one end of mid-section 100*b* is an upper section 100*a*. Upper section 100*a* comprises two side bars 12 and a head bar 11. A side bar 12 is pivotally attached to an end of each side bar 14 and the head bar 11 rigidly connects the opposite ends of the side bars 12.

Pivotally connected at the other ends of side bars 14 is a lower leg section 100*c*. A side bar 16 is pivotally mounted to an end of each side bar 14 and the side bars 16 are rigidly connected by foot bar 16F at their ends away from the pivotal connections.

Attached to each side bar 14 of mid-section 100*b* is a safety rail 80. The safety rail 80 may be raised or lowered in a known manner.

Figure 5:
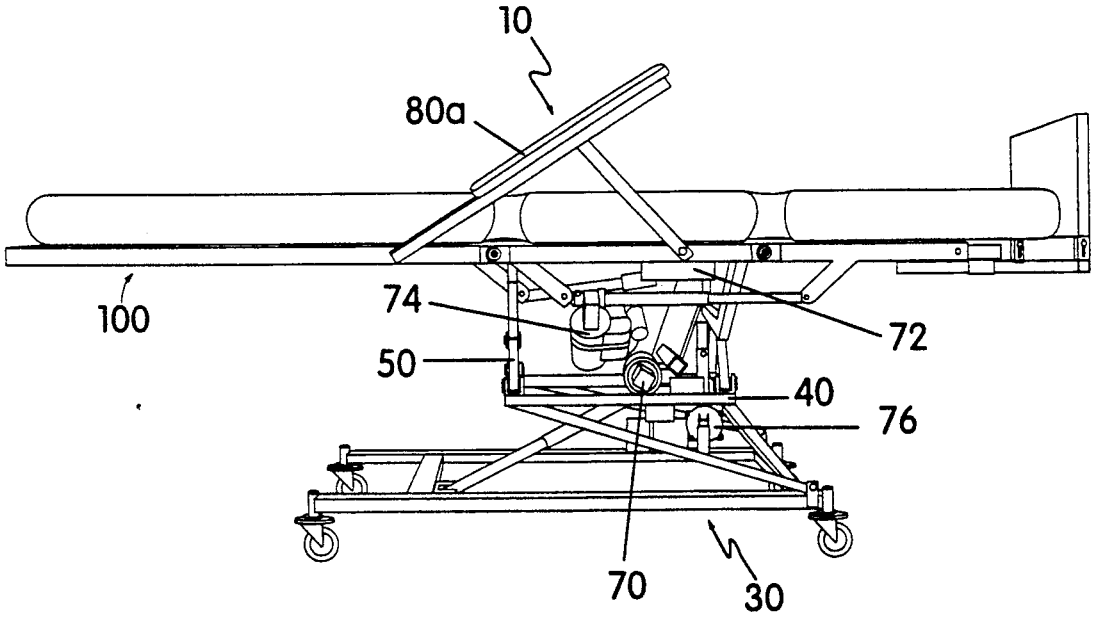
FIG. 5 is a side view of the bed-chair in the bed configuration and showing an alternative placement of the means for turning, tilting and articulating the upper frame.
Figure 6:
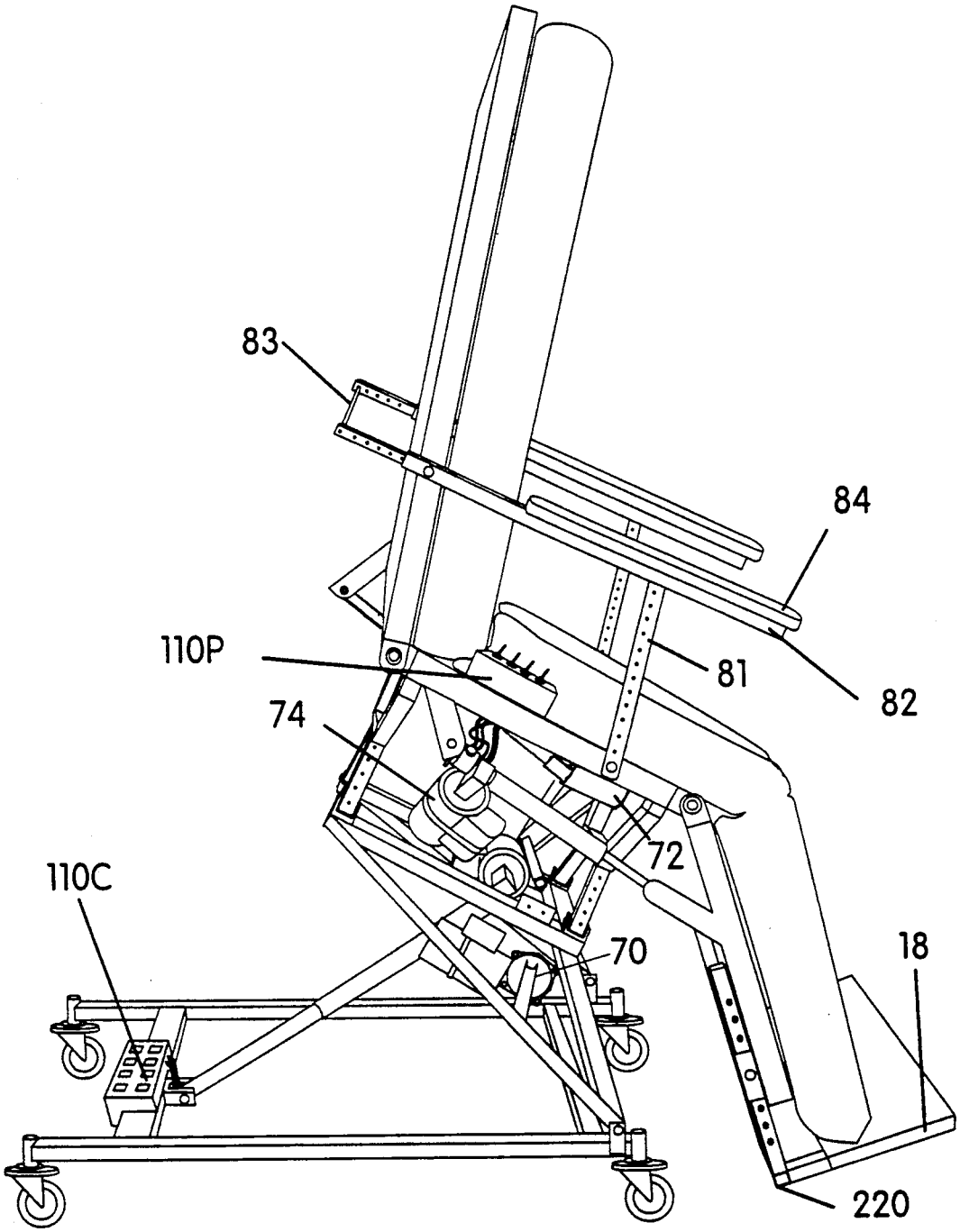
FIG. 6 is a side view of the bed-chair when in the lift chair mode for raising occupant onto feet and showing the alternative placement of the means for turning, tilting, and articulating the upper frame.
Figure 7:
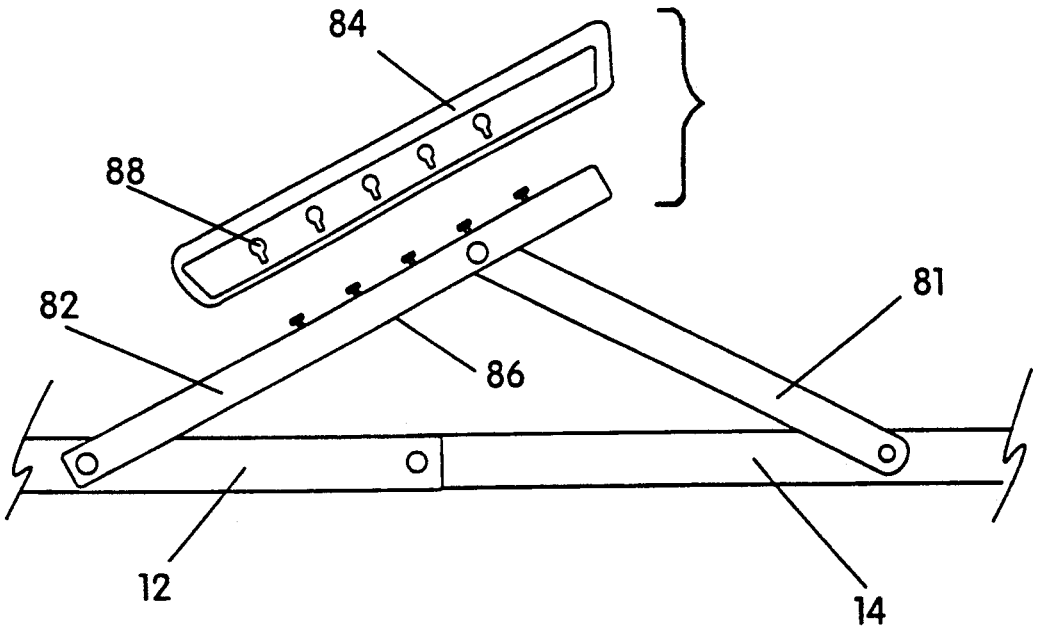
FIG. 7 shows a partially exploded view of an arm on the bed-chair used in place of a safety bar.

Alternatively, an articulated arm 80*a* is mounted on each side of the bed-chair (FIGS. 5 and 7). A support link 81 is pivotally mounted to side rail 14 and an arm rest portion 82 is pivotally mounted to side rail 12 with the second end of the support link 81 pivotally mounted to the underside of the arm rest portion 82. An arm rest 84 is removably mounted to the upper surface of the arm rest portion 82 (FIG. 7). The arm rest portion 82 may extend beyond the pivotal mount to side rail 12 such that a reinforcing bar 83 may extend between the extended arm rest portions 82 to providing additional rigidity to the arms 80*a* and to provide a push bar for when the bed-chair is in the chair configuration (see FIG. 6).

The upper portion of the arm rest portions 82 have mounted thereto a plurality of upwardly extending studs 86 having a narrow shaft portion and an enlarged head portion. The arm pads 84 have on their undersurface a complementary key shaped receptacle 88 for fitting over the studs 86 and being moved to a locked position wherein the slot of the key ways is retained between the head of the stud 86 and the upper surface of the arm rest portion 82 (FIG. 7).

Suspended between side bars 12, 14 and 16 is a mattress support structure. The mattress support structure can be fixed to the side bars 12, 14 and 16 by means of fasteners such as clamps, plates or screws so as to be removable and replaceable.

As shown in FIG. 1, the mattress support structure comprises slats 22 made of polycarbonate or other x-ray transparent material. However, the mattress support structure could be a cloth support, such as a solid canvas sheet or cloth strips, so long as it is x-ray permeable. The mattress support structure, as it extends between the side rails, is slightly concave to provide maximum support area to the patient.

Figure 8:
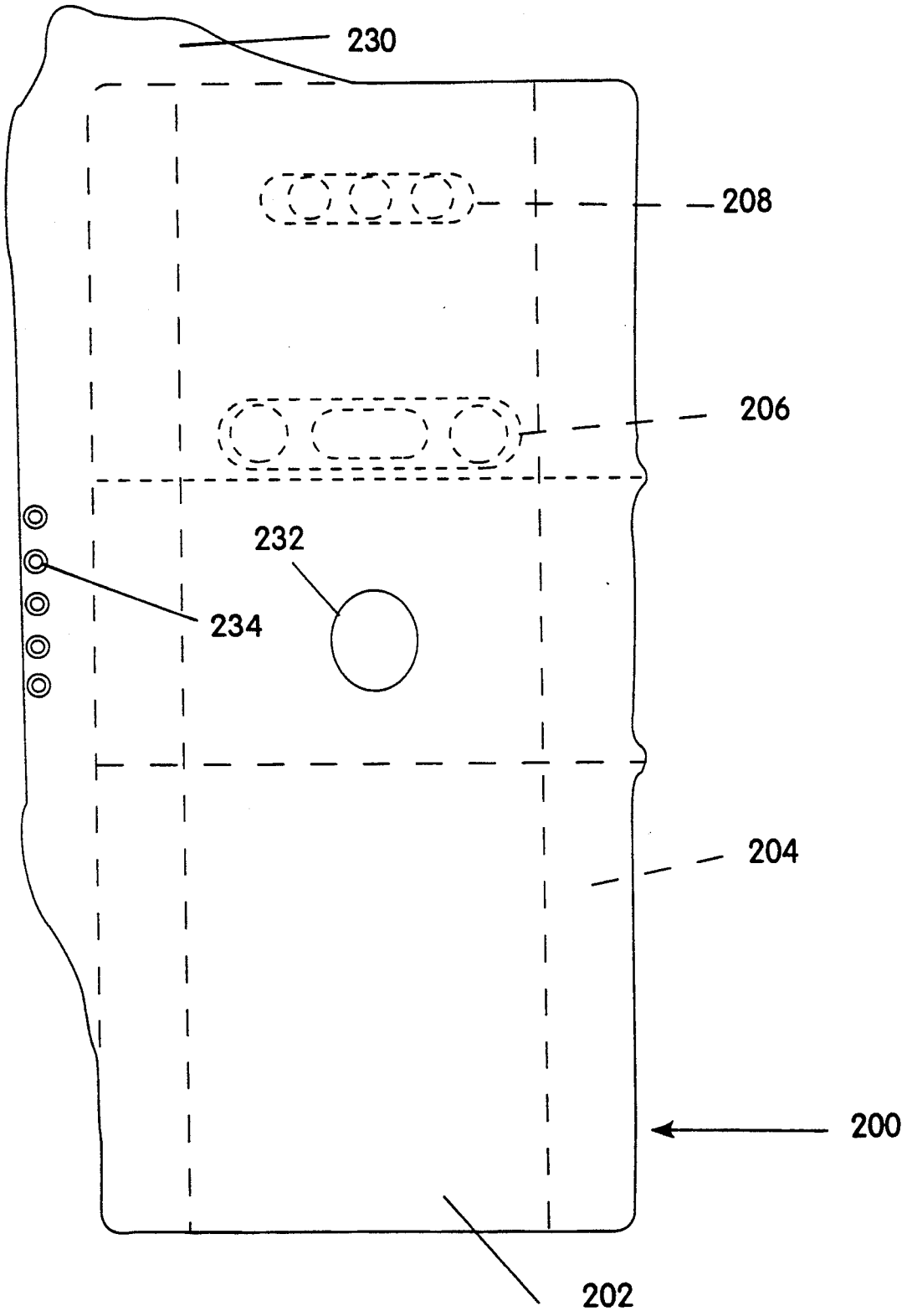
FIG. 8 shows a sheet on a bed mattress for use with the arm for assisting the patient with excretory functions.

Placed on the mattress support structure is a segmented mattress 200 having three segments 202, a segment corresponding to each of the three sections of upper frame 100 (FIG. 8). The basic segments are preferably of foam or air mattress type construction, but may be of any composition that fully and firmly supports the patient. Along each longitudinal edge is an enlarged inflatable tubular section, having three connected tubular segments 204, to provide elevated sides for increasing the cradling or concave security of the patient during turning of the bed, to be described later. Tubular segments 204 reduce the necessity for the safety side rails 80 and permit the use of the articulated arms 80*a* for many patients. Although it is preferable that the tubular segments 204 be inflatable, so that their volume is adjustable, they may be made of other materials such as down or mattress stuffing.

The mattress segments 202 and tubular segments 204 (FIG. 8) are enclosed in a moisture proof or moisture resistant cover that may be easily cleaned. Most preferably the cover has compartments into which the mattress segments 202 and tubular segments 204 may be removably inserted.

Further, pneumatic sections or pillows 206, 208 may be provided for cervical, thoracic or lumbar support. The sections 206, 208 are preferably pneumatic so that their three segments may be adjusted to the needs or wants of the patient The mattress cover may be provided with pockets for receiving the sections 206, 208 or the sections may be integral to the mattress cover. Adjustment of sections 206, 208, of three segments each, may be accomplished using a hand syringe, compressor or other source of air control. Sections 206, 208 are presented as examples only. Other locations for such devices would depend on patient need and the treatment required. The mattress 200 is covered by bedding appropriate to patient care.

The lower frame 30 is constructed of two side rails 32 and two end rails 34H, 34F to create a generally rectangular form as narrow and short as practical to facilitate movement of the bed and patient throughout the medical facility while providing the appropriate base for the various positions of the bed chair. A base approximately 28 inches wide by 40 inches long best satisfies the requirement. The base 30 may be augmented by removable stabilizers (not shown) to increase stability when the bed-chair 10 assumes different positions to be described below. Attached at each corner of the lower frame 30 is a pivotal wheel or caster 36 to facilitate easy movement of bed-chair 10. Further, at least two wheels 36 are provided with wheel locks of a type known in the art.

The mid-frame 40 comprises a rectangular support structure having two side bars 42, a cross bar 44F at the end toward the foot of the bed-chair 10 and a cross bar 44H toward the head of the bed-chair 10. Spanning the gap between side bars 42 and attached to the side bars 42 approximately two-thirds the distance from the head bar 44H toward the foot bar 44F may be placed a cross piece 49.

Each side bar 42 is fixedly mounted to a side assembly comprising an elongated brace 48 extending from a pivotable attachment point (the pivoted attachment being detachable for bed-chair disassembly), near the front wheel 36 proximate to the foot of the bed, on the side rail 32 to a fixed attachment point proximate the junction of the head bar 44H and side bar 42. A second brace 46 extends between brace 48, proximate the pivotal connection to side rail 32, to a fixed connection proximate to where side bar 42 joins foot bar 44H of the mid-frame 40. The rectangular base of mid-frame 40, comprising the two side bars 42 and the cross bars 44F,44H, is approximately one-third the width of the bed, one-half the length of lower frame 30 and substantially equal to the length of mid-section 100*b* of the upper frame 100.

Figure 4A:
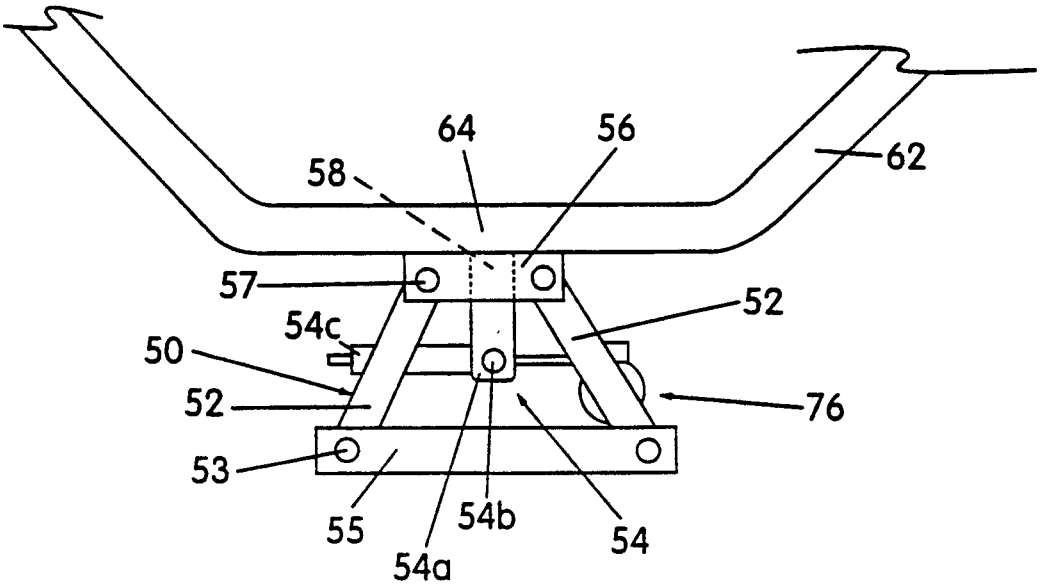
FIG. 4*a* is a view of the linking assembly when in normal horizontal position.

Connecting mid-frame 40 to the two cross braces 60 descending from side rails 14 of mid-section 100*b* are two linking assemblies 50 (one shown in FIG. 4*a*). When upper frame 100 is level, that is not turned to one side or the other, each linking assembly 50, when viewed on end (FIG. 2 and 4*a*), has a trapezoidal-shape.

Figure 4B:
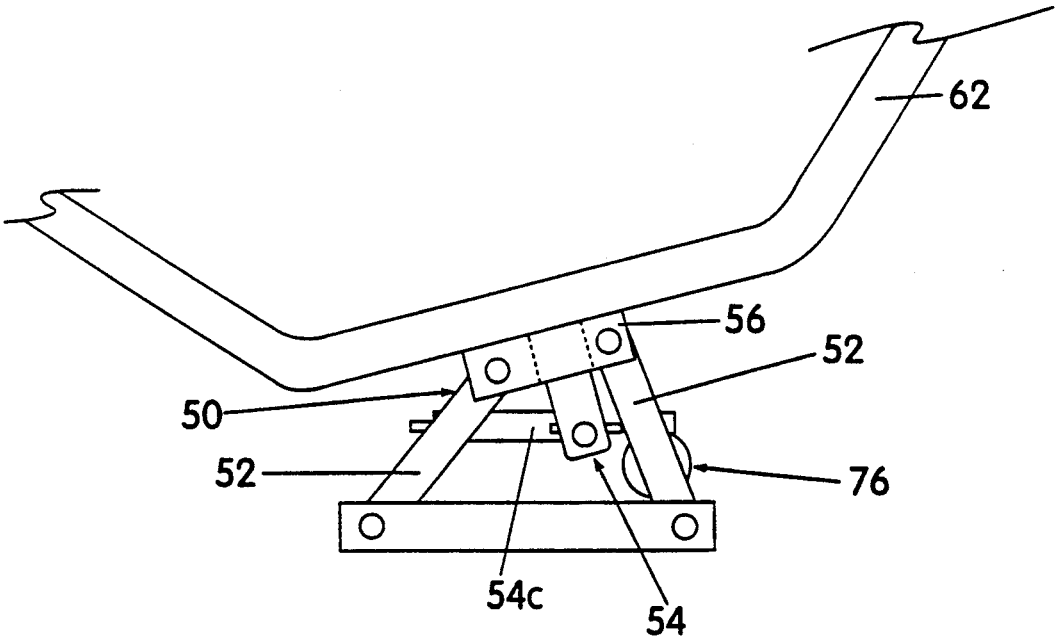
FIG. 4*b* is a view of the linking assembly when the bed-chair is turned to the patient's right.

A linking assembly 50 is mounted to each of the foot bar 44F and head bar 44H of mid-frame 40 by means of a base bar 55. Pivotally mounted at each end of the base bar 55 is an upwardly and inwardly sloping arm 52. Linking the two sloping arms 52, and pivotally connected thereto, is upper bar 56. Each upper bar 56 is removably mounted to an appropriate one of the cross braces 60 located at the head or the foot end of side bars 14 of mid-section 100*b*. Thus, when the bed is turned to one side, the linking assembly 50 is distorted to a substantially triangular shape as arms 52 pivot at pivot points 57 and 53 (FIG. 4*b* shows turning to the patient's right).

A foot plate 18 (FIG. 3) is mounted to upper frame 100 by inserting legs 17 into hollow centers of side bars 16 of lower leg section 100*c*. Alternatively, the legs 17 may be inserted in brackets suspended below the side bars 16 (FIG. 6). The foot plate 18 is locked in place by passing a cotter pin, bolt or similar fastening device through hole 19*a* in side bars 16, or the bracket, and one of a plurality of holes 19*b* in leg 17 of foot plate 18. The plurality of holes 19*b* in leg 17 allows foot plate 18 to be adjusted for individual patients. While the described mounting and adjusting means is the simplest structure, a number of alternative mounting and adjustment means would be apparent to one skilled in the art including a closed ball and socket joint.

The movement of the various elements of the bed-chair to a variety of positions may be accomplished by any one of a number of devices, such as pneumatic, hydraulic, and manual crank assemblies or by electrically driven expansion devices. For the preferred embodiment, four electrical linear actuators are employed.

In order to turn the bed from one side to the other, that is to roll the bed to an angle of turn approximately $\pm 20°$ from horizontal around the bed's longitudinal center line, a linear actuator 76 (FIGS. 3, 4A, 4B) is mounted on one of the side bars 42 of mid-frame 40. The worm screw in linear actuator 76 passes through its threaded sleeve 54*c* of turn assembly 54 (FIGS. 4A, 4B). Turn assembly 54 is attached to a brace 58 extending between upper bars 56. The turn assembly 54 has a U-shaped bracket 54*a* with the threaded sleeve 54*c* pivotally mounted by means of pins 54*b* inserted through holes in the arms of the U-shaped bracket 54*a*. Thus, actuating the linear actuator 76 to extend the turn assembly 54 produces a turn to the patient's left and to contract the assembly 54 produces a turn to the patient's right.

An alternative position for linear actuator 76 is shown in FIGS. 5 and 6. This alternative positioning requires modification of the turn assembly 54 but provides the same functionality.

A second linear actuator 72, mounted to one of the crossbraces 60 (shown in FIGS. 1 and 3 as cross brace 60 toward the head of the bed) has an extension member pivotally attached to a mount 13 that is attached to an underside of one of the side bars 12 of upper section 100*a*. Extending the extension member of the linear actuator 72 causes the upper section 100*a* to be elevated thereby moving the patient's upper body toward a sitting position and contracting the linear actuator 72 causes the upper section 100*a* to be lowered until it reaches a horizontal position wherein each side bar 12 is substantially a continuation of the side bar 14 to which it is pivotally attached. Alternatively, the linear actuator 72 could be suspended from a side rail 14 of mid-section 100*b* such as shown in FIGS. 5 and 6.

Figure 3:
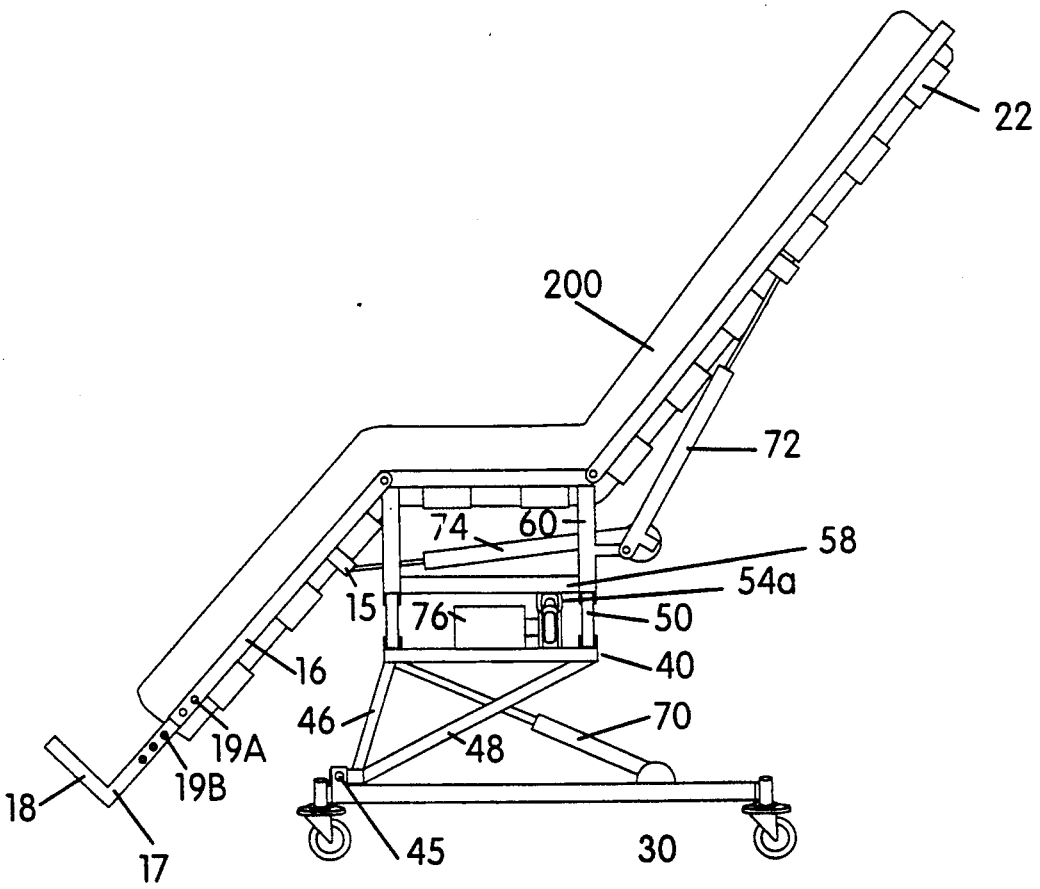
FIG. 3 is a side view of the bed-chair in the bed mode with mattress showing and of the means for turning, tilting, and articulating the upper frame.

A third linear actuator 74 is mounted at the opposite side of the cross brace 60 and an extension member is pivotally attached to a mount 15 extending from an underside of one of the side bars 16 of lower leg section 100*c* (FIGS. 1 and 3). The linear actuator 74 allows the lower leg section 100*c* to be drawn downwardly or extended to a horizontal position wherein each side bar 16 is substantially a continuation of the side bar 14 to which it is pivotally attached. An alternative mounting of linear actuator 74 is shown in FIGS. 5 and 6.

A fourth linear actuator 70 is mounted on the cross bar 34H of lower frame 30 and is pivotally attached at its end to foot bar 44F of mid-frame 40 (FIGS. 1 and 3). Extension of the linear actuator 70 allows the upper section 100*a*, of upper frame 100, to be raised above lower leg section 100*c* when the entire bed is lying in one plane, that is, the pitch of the mid-frame 40 and mid-section 100*b* is adjusted. Conversely, contraction of the linear actuator 70 relatively elevates the footbar 44F of mid-frame 40 so that the lower leg section 100*c* is above upper section 100*a* when the upper frame 100 lies in one plane. The range of motion is between $+65°$ of head above feet to $-15°$ of head below feet.

Although portrayed in FIG. 3 as having the linear actuator mounted to base frame 30 with its pivotal attachment at the end foot bar 44F of mid-frame 40, other placements are possible that would adjust the range of motion. For example, the pivotal attachment of the linear actuator end could be to a cross brace fixedly attached to each side bar 42 and placed between head and foot bars 44H, 44F. Likewise the linear actuator could be mounted on foot bar 44F, or the cross bar, and extend to a pivotal attachment on the base frame 30. As noted above, the precise placement of the linear actuators 70, 72, 74 and 76 is variable so long as the described functionality is provided.

By electronically linking the linear actuator 70 with the linear actuators 72 and 74, the patient may be moved through a broad continuum of positions that includes movement from a seated position, in the chair configuration, to a standing position to assist in movement to a wheel chair, toilet, walker or other therapeutic device. The continuum of positions provides exercise of leg and thoracic muscles.

As described in this preferred embodiment, the actuators are electrical. Therefore a control unit 110C to control the actuators is provided for use of the caregiver. As shown in FIG. 6, the control unit 110C of the caregiver is mounted to base frame 30 so as not to interfere with operation of the bed-chair 10 or to be readily accessible to the patient. Preferably the control unit 110C is removably mounted to the bed-chair 10 so that it may be positioned away from the bed-chair 10 to be more accessible to the caregiver.

A simpler control 110P is provided to the patient. Control 110P enables the patient to control the standard eight movements of the bed-chair, that is, turn right or left, tilt the entire bed frame 100 up or down, move the lower leg section 100*c* up or down and move the upper section 100*a* up or down and a combination of those movements.

For a patient having control of his hands and arms, the control 110P is a manual control and may also include a variable rate of turn capability. For a patient that is a quadriplegic, or is otherwise incapacitated, and unable to use the manual control, the control system is voice or noise activated. When the patient, using voice activated control 110P, is to be given control of the bed-chair, the caregiver turns on the voice activated control. The control 110P consists of a display of lights that cycles at a predetermined rate with a light corresponding to each of the eight standard movements being turned on and off in sequence. By uttering a sound when the light corresponding to the desired movement is lit, the bed control mechanism effects the desired action. The action is stopped automatically by a preset timed pulse duration control or upon a second utterance by the patient. Either way the light array recommences its cycle. The voice actuation level is set to filter out common noise levels in order to minimize undesired activation of movement. A relatively low but proximate sound signal has been found to be adequate.

In all cases, the caregiver's control panel 110C has the capability to deactivate some or all of the actions controllable by the patient. Also, the control unit 110C is further provided with the capability of automatically alternating the expansion and contraction of linear actuator 76 to provide for a continuing program of side-to-side turning motion of the bed. The duration of the side-to-side turning motion, that is the length of time to turn from one side to the other side, the interval between side-to-side turning motions, that is the pause between completion of turning in one direction and the start of turning in the other direction, and the period of time the turning continues are adjustable and can be set by the caregiver.

The adjustable and automatic control of tilting (i.e. the relative position of head to feet) can be achieved in the same way although, in the preferred embodiment, not at the same time. Accordingly, the control system 110C provides either autoturn or autotilt but not both at the same time. Either provides sufficient movement to prevent skin pressure sores.

A safety feature, consisting of a contact sensor 220 (FIG. 6), is mounted at each bottom corner of foot plate 18. The contact sensors 220 automatically shut off the turning action when the foot plate approaches the floor. This precludes the possibility of a turnover or damage to the floor or carpet should the lower leg section 100*c* be lowered if or when the bed is turning from one side to the other.

A further feature, providing an additional psychological sense of control of his/her care to the patient, is that the articulated arms 80*a* provide a simple excretory elevator. A sheet, or stretcher, 230 having a center hole 232 and an attachment means along the sides, such as grommets 234, adjacent the center hole 232, is placed over the mattress (FIG. 8). To use the excretory elevator, the arm rests 84 are removed from the arm rest portions 82 of the articulated arms 80*a* and the grommets 234 are engaged with the studs 86 found on the arm rest portions 82 while the frame 100 is in its flat, or bed, configuration. Raising the upper section 100*a*, which in turn elevates the articulated arms 80*a*, lifts the patient's body, by means of the sheet 230, from the mattress allowing a bed pan to be slipped between the sheet 230 and the mattress 200 permitting the patient to relieve him or herself. After cleanup, the bed pan is removed, the upper section 100*a* lowered, the sheet 230 disengaged from the studs 86 and retucked and the arm rests 84 remounted. Although shown as an opening in the sheet 230, the hole 232 may have a flap or other covering, or take another configuration so long as it provides a non-closable opening when being used.

Although the preferred embodiment has been described using electrical linear actuators, other actuators including manual cranks may be used. However, where the actuators are crank operated, there is no provision for patient adjustment of the bed. Use of other activating mechanisms such as hydraulic or pneumatic actuators also permit the patient to adjust the bed to its multiple positions similar to the linear actuators of the preferred embodiment but tend to be bulkier and thus less easily moved.

Further, the side to side rocking motion, afforded by the turn, need not be limited to plus or minus 20° but may be adjusted by the structural elements of turn assembly 54 or by controlling the linear actuator's degree of rotation. Also an option is the use of a slow acting actuator adjusted to a rate slower than can be perceived during autoturn, e.g. at the rate of the minute hand of a clock. For manual control through the control the rate returns to a slightly faster speed of rotation. Likewise, by attaching the adjustment end of the linear actuator 70 to the cross brace 49, the pitch of mid-frame 40, and mid-section 100*b*, is adjusted more rapidly although the relative control of the adjustment decreases.

Further, the linear actuators 72 and 74 may be combined and only one linear actuator used to move both the upper section 100*a* and the lower leg section 100*c* in directions opposite to one another, that is when upper section 100*a* is elevated, lower leg section 100*c* is lowered.

Although the preferred embodiment of the invention has been described above, it is obvious that various other modifications and changes may be made to the bed-chair combination without departing from the scope of the invention.

What is claimed is:

1. An articulated bed-chair for use in patient care, comprising:

a bed frame having a mid-section, an upper section pivotably connected at one end of said mid-section and a foot section pivotably connected at the other end of said mid-section;

a lower frame equipped to roll on the floor;

a mid-frame pivotably mounted at a forward portion to a forward portion of said lower frame;

a linking assembly between said mid-section of said bed frame and said mid-frame;

first actuating means for adjusting an incline of said upper section of said bed frame from a plane defined by said bed-chair when in a bed configuration;

second actuating means for adjusting an incline of said lower section from the plane defined by said bed-chair when in the bed configuration;

third actuating means for changing an incline from horizontal of said mid-section; and fourth actuating means for changing a roll of said bed frame about a longitudinal center line of said bed-chair extending from a foot to a head of said bed-chair, wherein said linking assembly comprises two trapezoidally shaped elements, a first trapezoidally shaped element mounted between a head rail of the mid-frame and a head brace of the mid-section of the bed frame and a second trapezoidally shaped element mounted between a foot rail of the mid-frame and a foot brace of the mid-section of the bed frame, each said trapezoidally shaped element having a top segment, a base segment and two side segments linking said top segment and said base segment, said side segments of each trapezoidally shaped element being pivotably connected to said base segment and said top segment such that the trapezoidally shaped elements can be distorted into a substantially triangular shape when turning the bed frame to a maximum degree of roll.

2. The articulated bed-chair as claimed in claim 1, wherein the roll is through an arc of ±20 degrees.

3. The articulated bed-chair as claimed in claim 1, wherein said first actuating means and said second actuating means are a single actuating means.

4. The articulated bed-chair as claimed in claim 1, further comprising:

an articulated arm mounted to each side of said bed frame so as to be raised when said upper section is elevated; and sheet means having an excretory opening and means for attachment to the articulated arms.

5. A bed-chair for changing the bodily attitude or posture of a patient, comprising:

a rectangular bottom frame having a foot end, a head end and two side bars linking the foot end and the head end;

a mid-frame with a rectangular top section having two side bars that are connected by a head rail and a foot rail and further having a cross piece between the side bars intermediate the head and foot rails and a lower section having two support parts, one support part attached to each of the side bars of the mid-frame at one end and pivotally connected at another end to one of the side bars of said bottom frame proximate the foot end;

an upper frame comprising a center section having a rigid structure having two side bars connected at their corresponding ends by a head brace and a foot brace;

an upper section having each of two upper side bars pivotally connected at one end to a first end of an associated side bar of the center section and the opposite ends of the upper section side bars rigidly attached to a head brace extending between the upper side bars; and a lower section having each of two side bars pivotally connected at one end to a second end of an associated side bar of the center section and the opposite end of the lower section side bars rigidly attached to a foot brace extending between the lower side bars, wherein the upper section, center section and lower section when lying in a single plane define a bed frame;

a linking means for attaching the center section of the upper frame to the top section of the mid-frame, the linking means for permitting the upper frame to be turned toward either side around a portion of a longitudinal axis of the bed frame passing through the center section;

at least three adjustment means for pivotally elevating and lowering the upper and lower sections of the upper frame, turning the upper frame to the patient's left and right and pivotally elevating and depressing the center section of the upper frame;

a support material between the side rails on each of the upper, center and lower sections of the upper frame; and lockable casters or wheels attached proximate each corner of the lower frame to provide easy movement of the bed-chair, wherein said linking means comprises two trapezoidally shaped elements, a first trapezoidally shaped element mounted between the head rail of the top section of the mid-frame and the head brace of the center-section of the upper frame and a second trapezoidally shaped element mounted between the foot rail of the top section of the mid-frame and the foot brace of the center-section the upper frame, each trapezoidally shaped element having a top segment, a base segment and two side segments linking the top segment and the base segment, the side segments of each trapezoidally shaped element being pivotably connected to the base segment and the top segment such that the trapezoidally shaped elements can be distorted into a substantially triangular shape when tilting the upper frame to a maximum degree of tilt.

6. The bed-chair as claimed in claim 5, wherein said maximum degree of tilt is ±20° around a longitudinal axis extending from a foot to a head of the bed-chair.

7. The bed-chair as claimed in claim 5, further comprising a mattress placed on the support material, said mattress having support sections along each longitudinal edge.

8. The bed-chair as claimed in claim 7, further comprising a moisture resistant cover for enclosing the mattress and the support sections; and stabilization means for providing at least one of cervical, lumbar and thoracic support, the stabilization means being in three segments, each segment individually adjustable in support provided.

9. The bed-chair as claimed in claim 5, wherein said support material has a concave shape.

10. The bed-chair as claimed in claim 9, wherein said support material is transparent to X-rays.

11. The bed-chair as claimed in claim 5, further comprising side support from a group consisting of a side rail adjustably mounted to each side of the upper frame and an articulated arm mounted to each side of the upper frame.

12. The bed-chair as claimed in claim 5, further comprising control means for controlling said at least three adjustment means to adjust the bed-chair to a plurality of positions.

13. The bed-chair as claimed in claim 5, wherein said at least three adjustment means comprise four adjustment means, a first adjustment means for elevating and lowering the upper section, a second adjustment means for elevating and lowering the lower section, a third adjustment means for turning the upper frame and a fourth adjustment means for elevating and depressing the center section.

14. The bed-chair as claimed in claim 13, wherein the four adjustment means are linear actuators.

15. The bed-chair as claimed in claim 14, wherein the control means further comprises a patient control device and a caregiver control device, the caregiver control device providing for disablement of at least a part of the patient control device and for automatic actions of the control means.

16. The articulated bed-chair as claimed in claim 15, wherein said patient control device is voice activated.

17. The bed-chair as claimed in claim 5, wherein the bed-chair may be disassembled into at least three component parts for ease of transport.

18. The bed-chair as claimed in claim 15, wherein said control means controls the linear actuators to adjust the bed-chair to a continuum of positions by one of elevating and lowering the upper section, elevating and lowering the lower section, elevating and depressing the center section, turning the upper frame, and a combination of at least two of elevating and lowering the upper section, elevating and lowering the lower section, elevating and depressing the center section, and turning the upper frame.

19. The bed-chair as claimed in claim 18, wherein turning the upper frame may be adjusted to set a duration of turn, an interval of turn and a time to cease turning.

20. An articulated bed-chair for use in patient care, comprising:

a bed frame having a mid-section, an upper-section pivotally connected at one end of said mid-section and a foot section pivotally connected at the other end of said mid-section;

a lower frame;

a mid-frame pivotally mounted to a forward portion of said lower frame;

a linking assembly between said mid-section of said bed frame and said mid-frame; and at least four actuating means for altering the configuration of the bed-chair, wherein the linking assembly comprises two trapezoidally shaped elements, a first trapezoidally shaped element mounted between a head rail of the mid-frame and a head brace of the mid-section of the bed frame and a second trapezoidally shaped element mounted between a foot rail of the mid-frame and a foot brace of the mid-section of the bed frame, each trapezoidally shaped element having a top segment, a base segment and two side segments linking the top segment and the base segment, the side segments of each trapezoidally shaped element being pivotally connected to the base segment and the top segment such that the trapezoidally shaped elements can be distorted into a substantially triangular shape when turning the bed frame to a maximum degree of roll around a portion of a centerline extending from a foot to a head of the bed-frame, the portion being that passing through the mid-section.

21. The articulated bed-chair as claimed in claim 20, wherein a first actuating means of said bed-chair of said at least four actuating means enables moving said upper section of said bed frame from at least a position lying in a plane passing through said mid-section to a position approximate that found in a chair back and all positions therebetween.

22. The articulated bed-chair as claimed in claim 21, wherein a second actuating means of said at least four actuating means enables adjusting said lower section from at least a position lying in the plane of said midsection in a downward direction and all positions therebetween.

23. The articulated bed-chair as claimed in claim 22, wherein a third actuating means of said at least four actuating means enables turning said bed frame around the centerline extending from a foot of the bed frame to a head of the bed frame.

24. The articulated bed-chair as claimed in claim 23, wherein a fourth actuating means of said at least four actuating means changes a pitch of said mid-section from horizontal such that an axial centerline of said mid-section has one of an upward and downward slope from a foot end to a head end.

25. The articulated bed-chair as claimed in claim 20, further comprising a patient control means for controlling operation of said at least four actuating means.

26. The articulated bed-chair as claimed in claim 25, further comprising a caregiver control means for controlling operation of said at least four actuating means, said caregiver control means capable of overriding and controlling operation of said patient control means.

27. The articulated bed-chair as claimed in claim 25, wherein said patient control means is voice activated.

28. The articulated bed-chair as claimed in claim 20, wherein said at least four actuating means comprise one type of actuator from the types consisting of electrical, mechanical, pneumatic and hydraulic actuators.

29. The articulated bed-chair as claimed in claim 20, further comprising control means for controlling said at least four adjustment means to adjust the bed-chair to a plurality of positions.

30. The articulated bed-chair as claimed in claim 20, further comprising:

means for controlling the linear actuators to adjust the bed-chair to a continuum of positions by one of elevating and lowering the upper section, elevating and lowering the lower section, elevating and depressing the center section, turning the upper frame, and a combination of at least two actions consisting of moving the center section by one of elevating and lowering, moving the lower section by one of elevating and lowering, moving the center section by one of elevating and depressing, and turning the upper frame.

31. The control unit as claimed in claim 30, further comprising:

a caregiver unit; and a patient unit, wherein the caregiver unit is capable of disabling at least one capability of the patient unit.

32. The control unit as claimed in claim 31, wherein said patient unit is voice activated.

33. An excretory elevator for an articulated bed-chair having a bed frame with at least an upper section and a main section, the upper section pivotally mounted to the main section, the excretory elevator comprising:

an articulated arm pivotably attached to each side of the bed frame; and sheet means having an excretory opening and attachment means for attaching the sheet means to each articulated arm, the attachment means positioned along each side edge of the sheet means adjacent the excretory opening, wherein each articulated arm comprises an arm rest portion, a support link, and an arm rest that is removably mounted to the arm rest portion, the arm rest portion being pivotably mounted to a side bar of the upper section and the support link pivotably mounted at a first end to a side bar of the mid-section and at a second end to an underside of the arm rest portion.

34. The excretory elevator of claim 33, further comprising a reinforcing bar extending between an end of each arm rest portion extending beyond the pivotal mount on a side opposite to where the arm rest portion and the support link are pivotally connected.

35. An articulated bed-chair, comprising:

an upper frame having a mid-section, a head section and a foot section, said head section and said foot section pivotally mounted at opposing sides of said mid-section;

a lower frame;

a mid-frame pivotally mounted to said lower frame;

a linking assembly between said mid-section of said upper frame and said mid-frame, said linking assembly having two elements each defining a trapezoidal shape, each element having a pair of arms inclined inwardly, toward a centerline that passes through said mid-section and extends from a foot end to a head end of said upper frame, from a pivotal mounting to said mid-frame to a pivotal mounting to said midsection such that the trapezoidal shapes can be distorted into a substantially triangular shape when tilting the upper frame around the centerline; and at least three actuating means.

36. The articulated bed-chair as claimed in claim 35, further comprising:

a patient control means; and a caregiver control means, wherein both control means permit adjustment of the bed-chair to a continuum of positions by a one of elevating and lowering the head section, elevating and lowering the foot section, elevating and depressing the mid-section, tilting the upper frame and a combination of at least two actions consisting of moving the upper section by at least one of elevating and lowering, moving the lower section by at least one of elevating and lowering, moving the center section by at least one of elevating and depressing, and tilting the upper frame, said caregiver control means capable of limiting the positions accessible through use of the patient control means.

37. The articulated bed-chair as claimed in claim 35, further comprising:

an excretory elevator having an articulated arm pivotably attached to each side of the bed frame, the pivotal attachment being at one end to said head section and at a second end to said mid-section; and sheet means having an excretory opening and an attachment means for attaching the sheet means to each articulated arm, the attachment means positioned along each side edge of the sheet means adjacent the excretory opening.

* * * * *